US005108298A

United States Patent [19]

Simmel

[11] Patent Number: 5,108,298

[45] Date of Patent: Apr. 28, 1992

[54] LATCHING AND EJECTING ELECTRICAL CONNECTOR ASSEMBLY

[75] Inventor: George M. Simmel, Kawasaki, Japan

[73] Assignee: Molex Incorporated, Lisle, Ill.

[21] Appl. No.: 679,699

[22] Filed: Apr. 3, 1991

[51] Int. Cl.[5] ..... H01R 13/62

[52] U.S. Cl. ..... 439/157; 439/160

[58] Field of Search ..... 439/152-160

[56] References Cited

U.S. PATENT DOCUMENTS

| | | | |
|---|---|---|---|
| 2,051,425 | 8/1936 | Schlums | 439/160 |
| 2,939,103 | 5/1960 | Agron et al. | 439/157 |
| 3,784,954 | 1/1974 | Grimm et al. | 439/160 |
| 4,070,081 | 1/1978 | Takahashi | 439/157 |
| 4,178,051 | 12/1979 | Kocher et al. | 339/45 M |
| 4,241,966 | 12/1980 | Gomez | 339/45 M |
| 4,341,428 | 7/1982 | Hatch et al. | 339/14 R |
| 4,410,222 | 10/1983 | Enomoto et al. | 339/17 F |
| 4,447,101 | 5/1984 | Gugliotti | 439/153 |
| 4,469,388 | 9/1984 | Narozny | 339/45 M |
| 4,531,795 | 7/1985 | Sinclair | 439/152 |
| 4,579,408 | 4/1986 | Sasaki | 339/45 M |
| 4,761,141 | 8/1988 | Hawk et al. | 439/153 |
| 4,973,255 | 11/1990 | Rudoy | 439/157 |
| 5,057,029 | 10/1991 | Noorily | 439/160 |

FOREIGN PATENT DOCUMENTS

| | | | |
|---|---|---|---|
| 62-145675 | 6/1987 | Japan . | |
| 1-151180 | 6/1989 | Japan . | |
| 2082401 | 3/1982 | United Kingdom | 439/152 |

*Primary Examiner*—David L. Pirlot

*Attorney, Agent, or Firm*—Charles S. Cohen; Stephen Z. Weiss

[57] ABSTRACT

An electrical connector assembly is provided for electrically connecting first and second connectors. The first connector includes at least one pivotally mounted lever movable between a mating position for the connectors and an eject position for selectively ejecting the second connector from the first connector. The lever includes an eject portion underlying and engageable with the underside of the second connector. The eject portion is elongated and tapered away from the underside of the second connector in a direction away from the pivot point of the lever whereby a greater moment arm is provided upon initial engagement of the eject portion with the underside of the second connector, and the moment arm decreases as the lever pivots toward its eject position.

18 Claims, 5 Drawing Sheets

| DEGREE OF LEVER ARM ROTATION | LEVER RATIO |
|---|---|
| 0° | 0 |
| 5° | 2.5:1 |
| 10° | 2:1 |
| 15° | 1.75:1 |
| 20° | 1.4:1 |
| 25° | 1.3:1 |
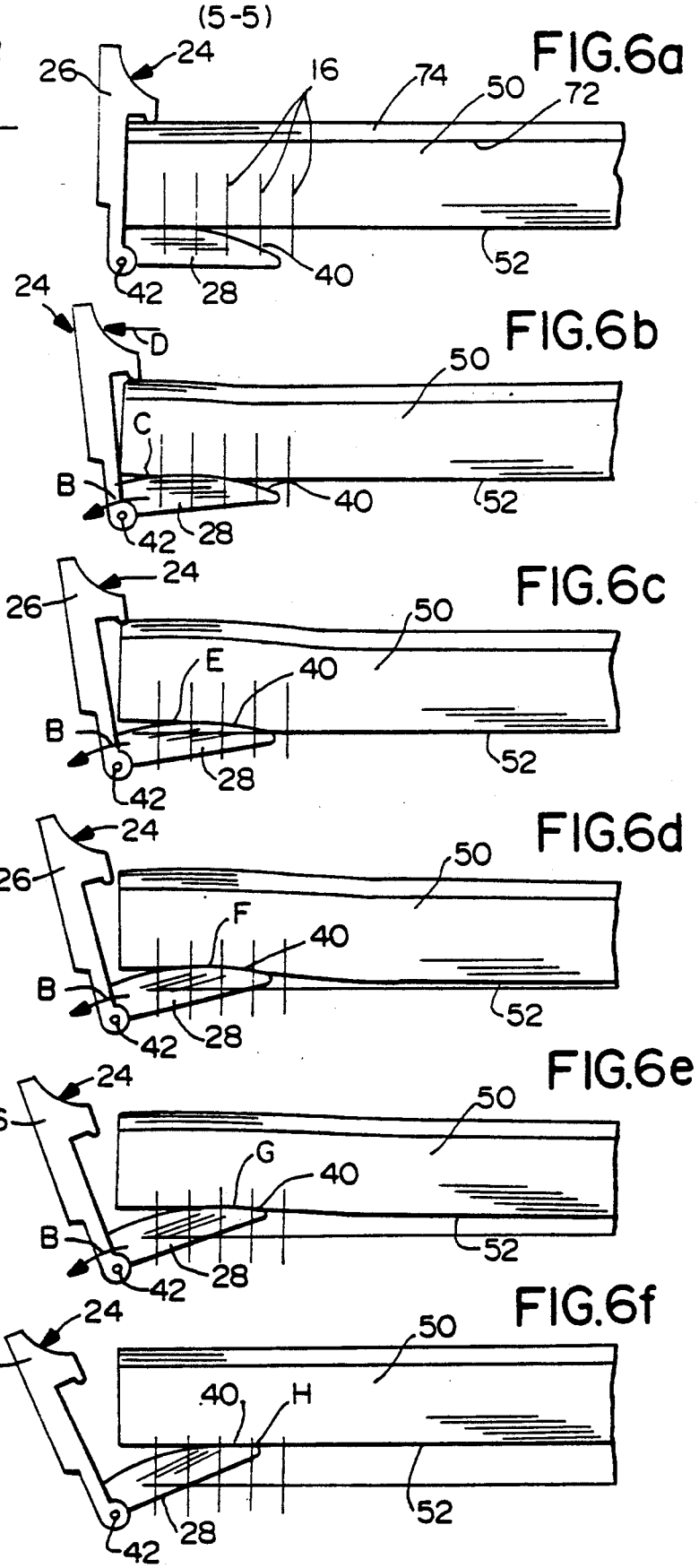

LATCHING AND EJECTING ELECTRICAL CONNECTOR ASSEMBLY

FIELD OF THE INVENTION

This invention generally relates to the art of electrical connectors and, particularly, to an electrical connector assembly which latches a pair of connectors together and facilitates separating the connectors.

BACKGROUND OF THE INVENTION

Electrical connector assemblies for making large numbers of interconnections are used extensively in the electrical connector industry, such as for use in computers and other similar electronic devices. The connector configurations and sizes vary considerably, and connectors for making twenty-six or more connections are very common. Each connection may be made by inserting a male pin terminal into a female terminal or socket, or by joining other types of mating terminals. Usually, the connector assemblies include two components, namely a header member and a connector member which is removably plugged into the header member. The header member may be mounted on a printed circuit board or other electronic element, and the connector member may be terminated to the end of a multiconductor cable.

Electrical connector assemblies of the type described above are well known in the art and include such features as means to assist the mating of the header and connector members with one another. In particular, it is desirable that such a feature be able to retain the connector member in mating relationship with the header member or, selectively, eject the connector member from the header member.

Examples of such latch/eject electrical connector assemblies are shown in U.S. Pat. Nos. 4,070,081; 4,105,275; 4,168,877; 4,410,222; 4,447,101; 4,469,388; 4,579,408; 4,640,565 and 4,761,141. The 4,410,222 patent to Enomoto et al., dated Oct. 18, 1983, is assigned to the assignee of this invention.

Although the various connector assemblies shown in the prior art enumerated above generally have been effective for their intended purposes, they all illustrate a common ejecting mechanism which comprises a relatively short eject arm which engages only the end of the connector housing usually at a single point of engagement. Such eject arms place a considerable limitation on the overall length of the connector to be ejected due to lateral bending of the connector. Of course, the length of the connector inherently limits the number of connections or terminals. In other words, since most of the connectors are held in the pin header by frictional engagement between the female terminals carried by the connector and the male pins in the header, there is substantial force which must be overcome during the unmating operation. Short eject arms with single point engagement limit the length of the connectors, the number of connections and the materials available for use in fabricating the connector.

This invention is directed to solving the problems outlined above by providing a novel eject mechanism which has a relatively long moment arm configured to provide a more effective moment arm function to accommodate longer connectors with more terminal connections.

SUMMARY OF THE INVENTION

An object, therefore, of the invention is to provide a new and improved electrical connector assembly for electrically connecting first and second connectors, such as a header and a mating connector, which includes novel connector ejecting means.

In the exemplary embodiment of the invention, a first connector, such as a header, includes at least one pivotally mounted lever means movable between a mating position for the connectors and an eject position for selectively ejecting the second connector from the first connector. The lever means include an eject portion underlying and engageable with the underside of the second connector. The invention contemplates that the eject portion be elongated and tapered away from the underside of the second connector in a direction away from the pivot point of the lever means. Therefore, a greater moment arm is provided upon initial engagement of the eject portion with the underside of the second connector, and the moment arm decreases as the lever means pivots toward its eject position as the second connector is gradually separated from the first connector.

More particularly, the eject portion of the lever means is tapered by means of a convex surface on an arc facing and contacting the underside of the second connector.

As disclosed herein, a pair of the lever means are located on the first connector for engaging opposite ends of the second connector. Each lever means is generally L-shaped, with one leg of the L-shape forming the eject portion and the other leg of the L-shape forming a manually manipulatable arm. The arm has a locking portion for engaging a recessed surface of the first connector when the lever means is in its mating position to latch the connectors in mated condition.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the following description taken in conjunction with the accompanying drawings, in which like reference numerals identify like elements in the figures and in which:

FIGS. 6(*a*)–6(*f*) are somewhat schematic illustrations of the ejecting operation of a connector from the pin header.

DESCRIPTION OF THE PREFERRED EMBODIMENT

Figure 1:
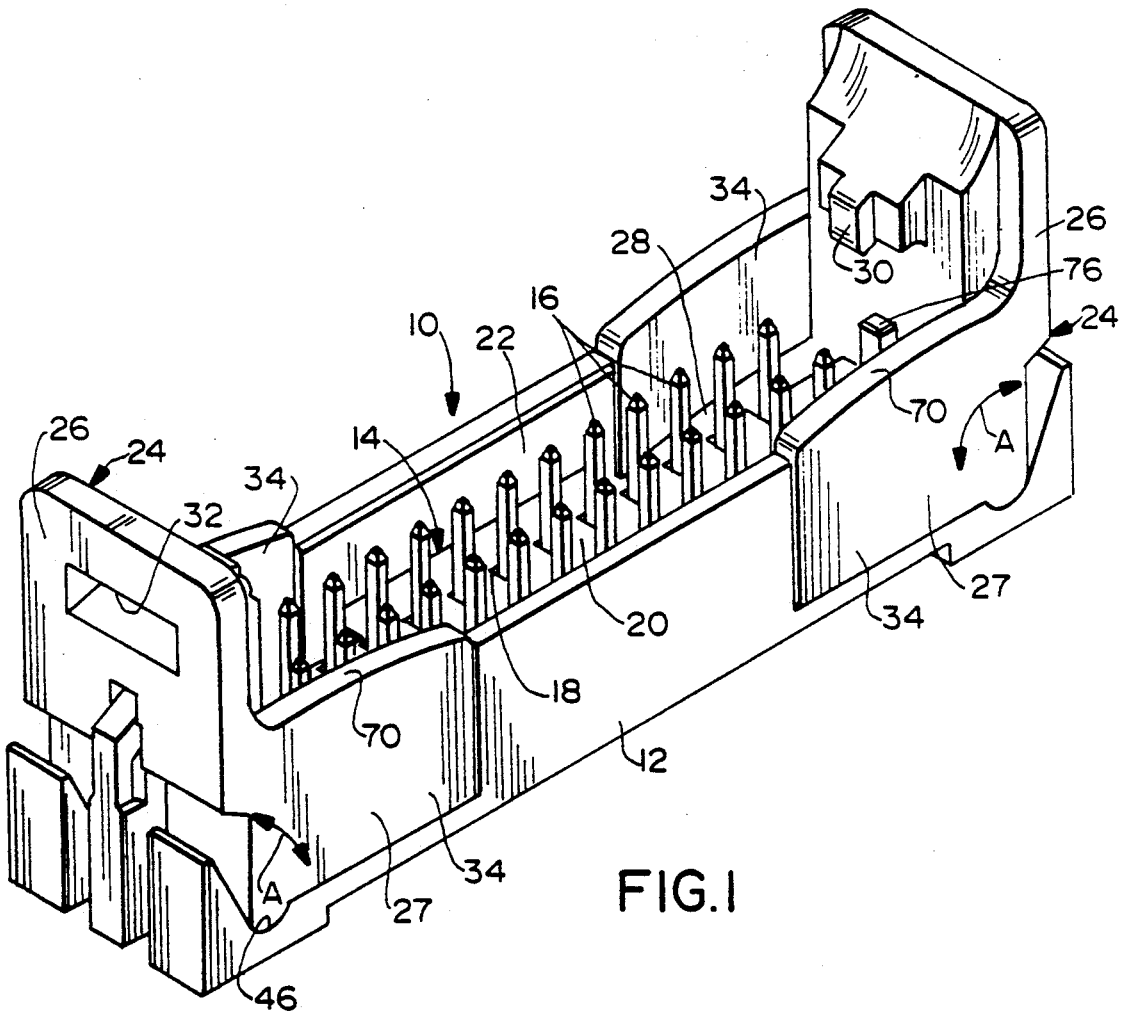
FIG. 1 is a perspective view of a latching and ejecting pin header incorporating the concepts of the invention.
Figure 5:
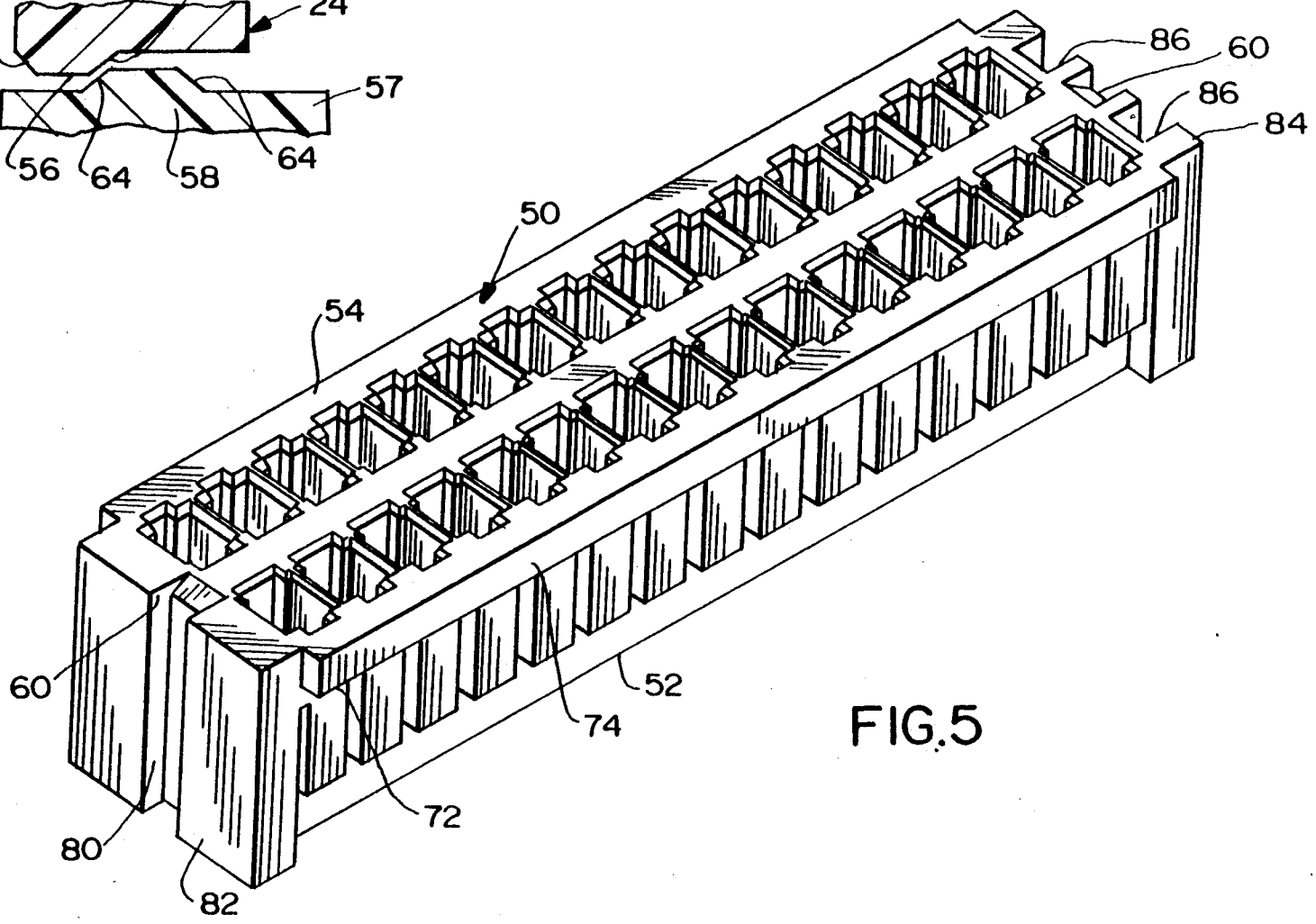
FIG. 5 is a perspective view of connector housing that mates with the latching and ejecting pin header of FIG. 1.

Referring to the drawings in greater detail, and first to FIG. 1, the invention contemplates an electrical connector assembly which includes a latching and ejecting pin header, generally designated 10. The header includes an elongate housing 12 defining an elongate cavity, generally designated 14, to receive a mating connector 50 (FIG. 5) therein. A plurality of male pin terminals 16 are fixedly mounted through apertures 18 in a floor 20 of housing 12. The floor defines a bottom wall of cavity 14, with side walls 22 of the housing defining the sides of the cavity and end walls 23 defining the ends of the cavity. The top 25 of such end walls and the tops 27 of side walls 22 are tapered towards cavity 14 to guide the connector 50 into the cavity. In essence, the housing provides a shroud for protecting pin terminals 16. The pin terminals normally will extend through the bottom of housing 12 to define solder tails for termination to circuit traces on a printed circuit board or to mate will still another connector component. The mating connector can be of any known configuration and will include female terminals or sockets for mating with pin terminals 16 by a frictional engagement. More specifically, it is anticipated that this eject lever structure is particularly useful with low profile connectors where the housings are particularly susceptible to bowing due to their relatively low height.

A pair of latching and ejecting lever means, generally designated 24, are pivotally mounted to opposite ends of housing 12 for pivotal movement in the direction of double-headed arrows "A". As will be understood hereinafter, each lever means is generally L-shaped with one leg 26 of the L-shape defining a manually manipulatable arm and another leg 27 defining eject portions 28 as described hereinafter.

Arm 26 of each lever means 24 includes a hook-shaped portion 30 facing inwardly for preventing the mating connector 50 (see FIG. 5) from being removed while arms 26 are in their locked positions. The hook-shaped portion 30 faces inward for engaging the top surface 54 of connector 50 while the lever means is in its locked position as shown in FIG. 1. Connector 50 has a tapered slot 60 (FIG. 5) located in its top surface 54 adjacent each lever means dimensioned so that hook-shaped portion 30 can pass therethrough and permit the housing to begin to raise up off of the header.

Housing 12, connector 50 and lever means 24 are molded of dielectric material, such as plastic or the like, and each arm 26 of each lever means 24 includes a molded recess 32 as shown in the left-hand lever means in FIG. 1. Each lever means 24 includes side wall portions 34 which extend from and are integrally formed with eject portions 28 so that side wall portions 34 form continuations of side walls 22 of housing 12 to protect the end-most pin terminals 16. By integrally forming the eject portion 28 with its adjacent side wall 34, additional strength and rigidity is provided which permits the eject portions 28 of the lever means to be of substantial length. By increasing the length of the eject portions 28, connector 50 can be ejected with less rotation of arms 26. Thus, the headers 10 can be mounted closer together on a circuit board than a header having a conventional latch mechanism.

Figure 2:
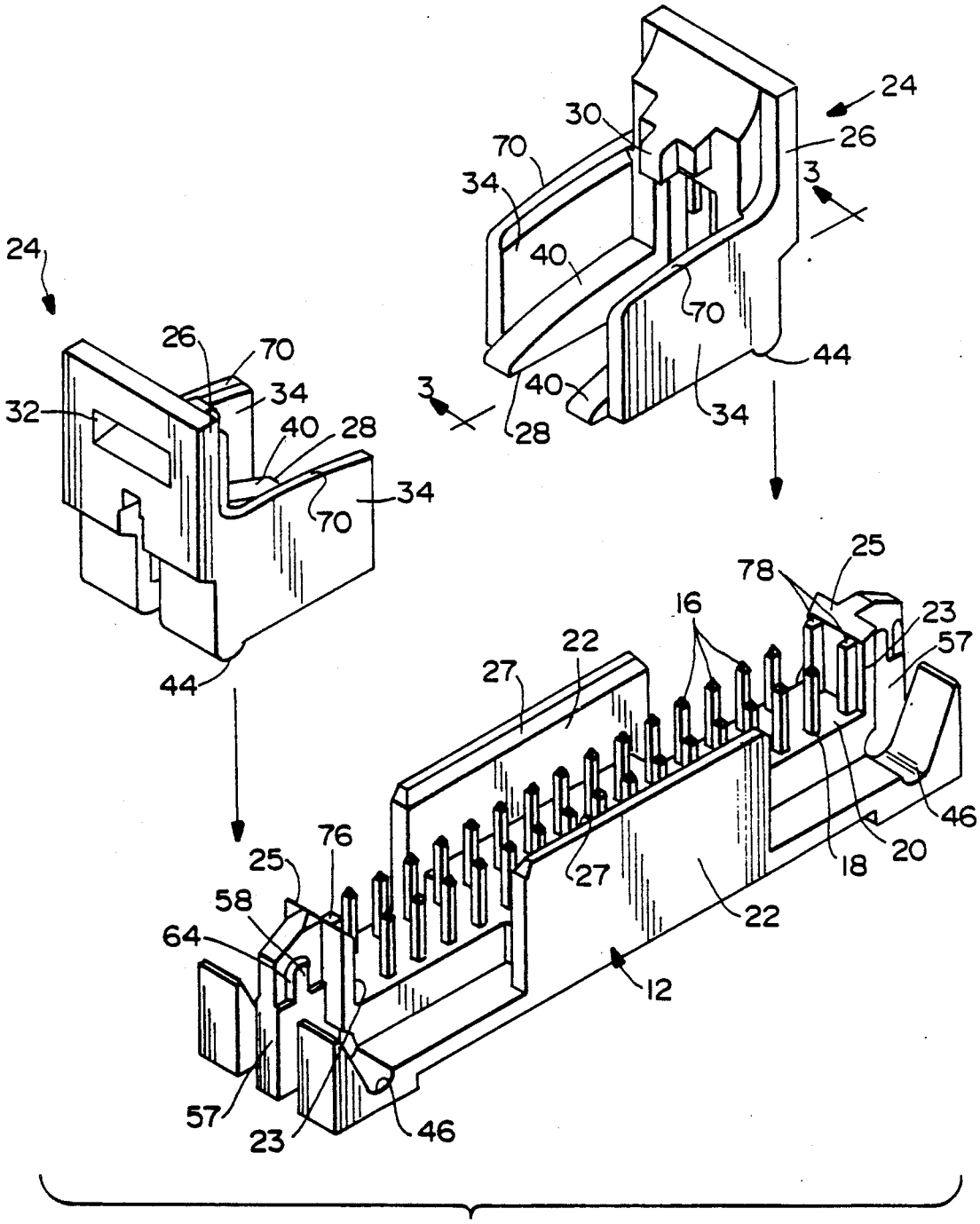
FIG. 2 is an exploded perspective view, on an enlarged scale, of the latching and pin header of FIG. 1 rotated 180°.
Figure 3:
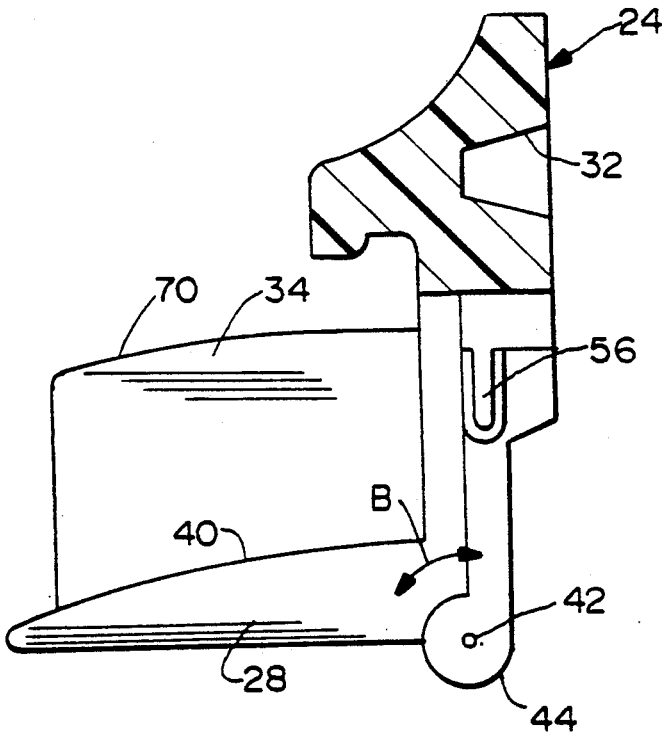
FIG. 3 is a vertical section, on an enlarged scale, taken generally along line 3—3 of FIG. 2.

FIG. 2 shows the opposed pair of lever means 24 in greater detail and illustrate that a pair of eject portions 28 are formed inside each side wall 34 of each lever means 24. The eject portions of each lever means are transversely spaced in order to accommodate the ends of housing 12 and the end-most terminal pins therebetween. FIGS. 2 and 3 also shows that eject portions 28 are of considerable length in comparison to the prior art enumerated hereinbefore.

Figure 4:
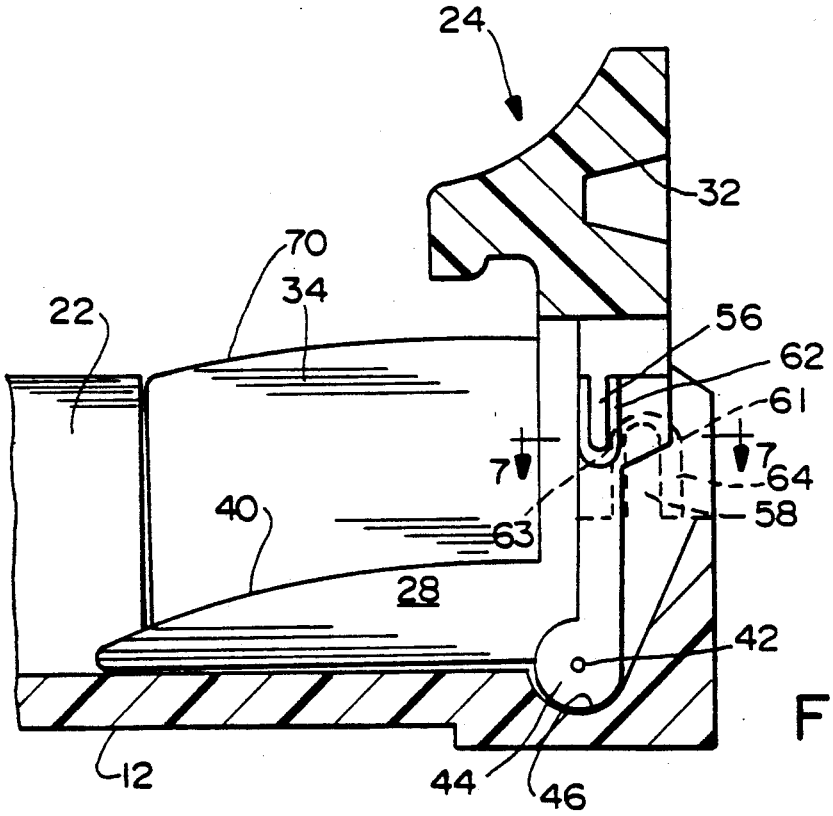
FIG. 4 is a vertical section, on enlarged scale, similar to FIG. 3, showing the interaction of the latch/eject mechanism as mounted on the pin header of FIG. 1.

The invention contemplates that elongated eject portions 28 be tapered away from the underside of the mating connector in a direction away from a pivot point 42 (FIGS. 3 and 4) of lever means 24. This provides a greater moment arm upon initial engagement of the eject portions with the underside of the mating connector, and the moment arm decreases as the lever means pivot toward the fully ejected position. Even though eject portions 28 get thinner radially away from pivot point 42, eject portions 28 do not bend due to the rigidity provided by side walls 34.

More particularly, referring to FIG. 3 in conjunction with FIGS. 1 and 2, each eject portion 28 is tapered by means of a convex upper surface 40 which is on an arc facing the underside of the mating connector. Each lever means 24 is pivoted to housing 12 about a pivot point 42 (FIG. 3) afforded by an enlarged circular pivot boss 44 molded integrally with lever means 24 and snap-fit into circular sockets 46 (FIG. 4) molded integrally with housing 12. Therefore, each lever means pivots in an eject direction as indicated by arrow "B" in FIG. 3.

Figure 7:
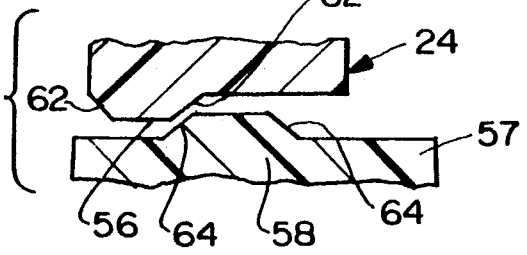
FIG. 7 is a horizontal section, on line 7—7 of FIG. 4.

Lever means 24 also includes a pair of arcuate locking fingers 56 (FIG. 4), each of which project inwardly towards post 57 on each end of housing 12. Post 57 has a pair of outwardly projecting locking bumps 58 positioned to engage locking fingers 56 during rotation of lever means 24. The locking fingers 56 have tapered portions 62 and locking bumps 58 have tapered portions 64 (FIG. 7) so that upon rotation of lever means 24, the tapered portions "ride up" each other and the legs 27 flex outward away from post 57 to permit locking fingers 56 to pass over locking bumps 58. As a result, lever means 24 can be held securely in either a fully open or closed position. When in the open position, lever means is positioned such that looking fingers 56 are positioned on the side 61 of locking bumps 58 opposite cavity 14. When in the closed position, locking fingers 56 are positioned on the side 63 of locking bumps adjacent cavity 14. Because lever means is made from a resilient material such as plastic, the legs 27 flex as the locking fingers pass over the locking bumps. As locking fingers 56 approach their locked position, hook-shaped portion 30 of lever means 24 moves downward towards the top surface 54 of connector 50 to secure the connector to header 10.

It should be noted that the top surface 70 of side wall portions 34 may be shaped and dimensioned to contact the underside 72 of ledge 74 during the ejection of the connector 50. Further, the top surface 70 could be curved in a manner similar to upper surface 40 of eject portion 28 in order to provide an additional area of contact which would reduce the stress on the contact points.

An additional feature of the present invention is the use of polarization ribs located on the ends of the header 12 to ensure that connector 50 is mated in the proper orientation. As such, a single vertical rib 76 extends into cavity 14 adjacent one of posts 57 and two spaced vertical ribs 78 extend into cavity 14 adjacent the other post (FIG. 2). Mating connector housing 50 has one vertical slot 80 at a first end 82 into which rib 76 extends during mating of the connector and the header. The opposite end 84 of connector housing 50 has two spaced vertical slots 86 for receiving ribs 78. As a result, connector 50 can only be inserted in one orientation.

FIGS. 6(*a*)–6(*f*) schematically illustrate the novel functional operation of elongated, tapered eject portions 28 of lever means 24. In the sequential views, the housing of header 10 is not shown to facilitate the illustration, with only terminal pins 16 being schematically illustrated in their fixed relationship relative to lever means 24. A receptacle connector housing 50 is illustrated somewhat schematically, with a generally planar underside 52 engageable by eject portions 28. As stated above, the receptacle connector housing would include female terminals or sockets for mating with terminal pins 16 by a frictional engagement. Of course, other force-fit mating terminals are contemplated.

In particular, FIG. 6(*a*) shows the mated condition of the receptacle connector with the header. FIG. 6(*b*) shows initial pivoting of lever means 24 in an eject direction as indicated by arrow "B", with an area of tapered surface 40 nearest pivot point 42 engaging underside 52 of connector 50, as indicated at "C". It can be seen that the initial "engaging length" of eject portion 28 is relatively short to provide a large moment for arm 26 when manually manipulated in the direction of arrow "D". During this initial ejecting movement, the end of receptacle connector 50 begins to lift, initially moving the female terminals off of the end-most pin terminals 16 to the left in the illustration. At this point, the centermost pin terminals are typically not yet affected due to the elasticity in the connector 50. Such elasticity is exaggerated for illustration purposes in FIGS. 6*b*–6*e*. Of course, it must be understood that there also is a lever means 24 on the opposite end of the connector assembly. FIG. 6(*b*) represents a pivoted position of lever means 24 on the order of 5°. It has been found that at this point, the lever ratio is on the order of 2.5:1.

FIGS. 6(*c*) and 6(*d*) represent continuing positions of ejecting rotational movement of lever means 24 in the direction of arrow "B" whereby the respective points of engagement between eject portion 28 and the underside 52 of connector 50 move away from pivot point 42 as schematically indicated at "E" and "F" in the respective figures. It can be seen that the moment of arm 26 of lever means 24 progressively decreases as the lever means pivots further toward its eject position. As the lever means continues to rotate, hook-shaped portions 30 slide through slot 60 of connector 50.

FIG. 6(*c*) represents a position where the lever means has been pivoted approximately 10 and FIG. 6(*d*) represents a position wherein the lever means has been pivoted approximately 15° away from the mating position of the lever means shown in FIG. 6(*a*). The lever ratios at these points, as represented by FIGS. 6(*c*) and 6(*d*), have been found to be on the order of 2:1 and 1.75:1, respectively. In the position of FIG. 6(*d*), the entire receptacle connector 50 has been lifted off of floor 20 (FIG. 1) of header 10. It can be understood that prior to ejection, static friction acts upon all of the pins and terminals. As the mating connector is lifted off of the header, the frictional forces are reduced since dynamic friction is less than static friction. Further, because of possible bowing of the connector, the end-most terminal pins of the header are disengaged earliest from the female terminals of the connector. Each of these factors decreases the forces required to fully disengage the connector.

FIGS. 6(*e*) and 6(*f*) represent continuing movement of lever means 24 in the eject direction for completely lifting connector 50 off of header 10 until the female terminals in the connector come free of the terminal pins in the header. FIGS. 6(*e*) and 6(*f*) represent approximately 20° and 25° of rotation, respectively. Of course, because of the taper or curvature of convex surface 40 on eject portion 28, the points of engagement of the surface with the underside of the mating connector move further away from pivot point 42, as indicated schematically at "G" and "H" in FIGS. 6(*e*) and 6(*f*), respectively. As described above, the moment of arm 26 of lever means 24 conversely decreases, but the forces required to completely free the female terminals from the pin terminals, of course, have decreased considerably and excessive ejecting forces are not required. It has been found that the lever ratio of lever means 24 in FIGS. 6(*e*) and 6(*f*) are on the order of 1.4:1 and 1.3:1, respectively.

From the foregoing description of FIGS. 6(*a*)–6(*f*), it can be understood that a large moment arm is provided for lever means 24 when the largest forces are required to unmate the connector from the header. As the required unmating forces decrease, the moment arm likewise decreases. Yet, the elongated eject portion 28 maintains constant engagement with the underside of the unmating connector throughout the entire pivoting rotation of the lever means. All of this is afforded by tapering the eject portion away from the underside of the mated connector in a direction away from the pivot point of the lever means. This tapered configuration permits the use of relatively long eject portions in comparison with the prior art. The mated connector can be ejected with less arm movement, yet still providing a large initial moment arm when the required ejecting forces are the greatest. The tapered configuration also permits a greater contact area between the connector housing and the eject portions to minimize stresses on the eject portions and, consequently, allow a wider range of materials to be used in fabricating the lever means.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. An electrical connector assembly for electrically connecting terminals of a first connector to terminals of a second connector, the first connector including a first mating face for mating with a mating face of said second connector that is generally parallel to said first mating face, a pair of opposed ends, a pair of opposed sides generally perpendicular to said ends and one pivotally mounted lever means adjacent each end, each lever means being movable between a mating position at which the connectors are mated together and an eject position at which the connectors are mated together and an eject position for selectively ejecting the second connector from the first connector, the lever means being molded and generally L-shaped, with one leg of said L-shape including an eject portion adjacent and engageable with said mating face of the second connector, said mating face of the second connector overlying said eject portion when said first and second connectors are mated together and said lever means is in said mating position, the other leg of said L-shape including a manually manipulatable arm that is generally planar and oriented perpendicular to said first mating face and parallel to said ends of said first connector when said lever means is in said mating position, the improvement comprising:

said eject portion comprising a pair of generally elongated arms oriented generally perpendicular to said manually manipulatable arm and spaced transversely from each other relative to the first connector and which generally taper away from said mating surface of the second connector in a direction radially away from the pivot point of the lever means whereby a greater moment arm is provided upon initial engagement of the eject portion with said first surface of the second connector, the moment arm decreasing as the lever means pivots toward its eject position; and said lever means further comprising stiffening means for providing additional rigidity to said elongated arms to reduce bending of said arms.

2. The electrical connector assembly of claim 1 wherein said lever means is a one-piece plastic material and said stiffening means is integrally molded between said eject portion and said manually manipulatable arm.

3. The electrical connector assembly of claim 1 wherein said eject portion is tapered by means of a convex arc on a surface facing said first surface of the second connector.

4. The electrical connector assembly of claim 3, wherein said lever means engage opposite ends of the second connector.

5. The electrical connector assembly of claim 4 wherein said stiffening means comprises a member that is generally planar and fixed to both said eject portion and said manually manipulatable arm, the plane of said member being generally parallel to the direction of ejection of said second connector from said first connector.

6. The electrical connector assembly of claim 1 wherein said lever means include a locking portion for engaging a mating surface of said first connector when the lever means is in its mating position.

7. The electrical connector assembly of claim 6 wherein said stiffening means comprises a member that is generally planar and fixed to both said eject portion and said manually manipulatable arm, the plane of said member being generally parallel to the direction of ejection of said second connector from said first connector.

8. The electrical connector assembly of claim 7 further comprising polarizing means associated with said first and second connectors.

9. An electrical connector assembly for electrically connecting first and second elongated connectors, the first connector including a pair of unitary lever means located at opposite ends thereof for engaging opposite ends of the second connector, each lever means being pivotable about a pivot point between a mating position at which the first and second connectors are mated together and an eject position for selectively ejecting the second connector from the first connector, each lever means being generally L-shaped with one leg of the L-shape forming a manually manipulatable arm and the other leg of the L-shape forming an eject portion underlying and engageable with the underside of the second connector, and said unitary lever means further including on opposite sides thereof a stiffening member fixed to and extending between said eject portion and said manually manipulatable arm, the manually manipulatable arm having a member projecting over said second connector when said first and second connectors are mated together and said lever means is at said mating position to prevent removal of said second connector without moving said lever means away from said mating position, the eject portion being generally elongated and generally tapered away from the underside of the second connector in a direction away from the pivot point of the lever means whereby a greater moment arm is provided upon initial engagement of the eject portion with the underside of the second connector, the moment arm decreasing as the lever means pivots toward its eject position, the distance from said pivot point to the end of said eject portion being greater than the distance from said pivot point to said projecting member.

10. The electrical connector assembly of claim 9 wherein said eject portion is tapered by means of a convex arc on a surface facing an underside surface of the second connector.

11. The electrical connector assembly of claim 10 wherein each said stiffening member is generally planar and the plane of said members are generally parallel to a longitudinal axis through said housing and the direction of ejection of said second connector from said first connector.

12. A latching and ejecting pin header, comprising:

an elongated housing having first and second ends and a pair of generally parallel housing sidewalls defining an elongated cavity adapted to receive a mating connector therein, said housing sidewalls bounding a middle portion of said cavity between said ends;

a plurality of terminal pins mounted in said cavity;

a latching and ejecting lever means pivotally mounted on the housing adjacent each end thereof for movement between a locking position and an eject position, the lever means including a latch arm portion and an eject portion selectively extendable into the cavity for engagement with the underside of the mating connector, the eject portion including a pair of generally elongated members spaced transversely from each other relative to the header that have a thickness that decreases in a direction radially away from the pivot point of the lever means whereby a greater moment arm is provided upon initial engagement of the eject portion with the underside of the mating connector, the moment arm decreasing as the lever means pivots toward its eject position, said lever means including lever sidewalls unitarily formed with said eject portion, said lever sidewalls forming a continuation of the housing sidewalls and bounding portions of said cavity adjacent said first and second ends, one of said housing sidewalls and one lever sidewall of each lever means forming a generally planar sidewall protecting a portion of the terminal pins.

13. The latching and ejecting pin header of claim 12 wherein said eject portion is tapered by means of a convex arc on a surface facing an underside surface of the mating connector.

14. The latching and ejecting pin header of claim 12 including a pair of said lever means located on the elongated housing for engaging opposite ends of the mating connector.

15. The latching and ejecting pin header of claim 12 wherein said lever means include a locking portion on the latch arm portion for engaging a mating surface of the header when the lever means is in its mating position.

16. The latching and ejecting pin header of claim 12 wherein endmost of said plurality of terminal pins are located between the sidewalls of the lever means.

17. The latching and ejecting pin header of claim 16 wherein said endmost terminal pins are disposed between said elongated members.

18. The pin header of claim 17 wherein said lever sidewalls are fixed to both said latch arm portion and said eject portion to provide additional stiffness to said eject portion in order to reduce bending of the eject portion.

* * * * *